US006112924A

United States Patent [19]

Zhang

[11] Patent Number: 6,112,924

[45] Date of Patent: Sep. 5, 2000

[54] CONTAINER WITH BASE HAVING CYLINDRICAL LEGS WITH CIRCULAR FEET

[75] Inventor: Qiuchen Peter Zhang, Wilmington, N.C.

[73] Assignee: BCB USA, Inc., Tampa, Fla.

[21] Appl. No.: 09/150,563

[22] Filed: Sep. 10, 1998

[51] Int. Cl.[7] ..... B65D 1/02; B65D 23/00

[52] U.S. Cl. ..... 215/375; 220/606; 220/608

[58] Field of Search ..... 215/373, 375, 215/377; 220/606, 608, 609

[56] References Cited

U.S. PATENT DOCUMENTS

| | | | |
|---|---|---|---|
| D. 269,158 | 5/1983 | Gaunt | 215/375 X |
| 4,175,670 | 11/1979 | Reynolds et al. | 220/606 |
| 4,313,545 | 2/1982 | Maeda | 220/606 X |
| 4,318,489 | 3/1982 | Snyder et al. | 215/1 C |
| 4,380,306 | 4/1983 | Knopf | 220/606 X |
| 5,320,230 | 6/1994 | Hsiung et al. | 215/1 C |
| 5,353,954 | 10/1994 | Steward et al. | 220/608 |
| 5,484,072 | 1/1996 | Beck et al. | 215/375 |
| 5,549,210 | 8/1996 | Cheng | 215/375 |
| 5,603,423 | 2/1997 | Lynn et al. | 215/375 |
| 5,626,228 | 5/1997 | Wiemann et al. | 220/606 X |
| 5,850,932 | 12/1998 | Beck et al. | 220/608 X |

FOREIGN PATENT DOCUMENTS

| | | | |
|---|---|---|---|
| 257588 | 2/1990 | Japan | 220/606 |
| 2067160 | 7/1981 | United Kingdom | 215/377 |

*Primary Examiner*—Sue A. Weaver
*Attorney, Agent, or Firm*—Wolf, Block, Schorr and Solis-Cohen LLP

[57] ABSTRACT

A blow-molded container has a central axis, a neck and a cylindrical sidewall connected with the neck, generally centered about the central axis and having an end. A generally hemispherical base wall encloses the end of the sidewall. A plurality of legs extend from and are circumferentially spaced about the base wall. Each leg has a radially outermost portion offset inwardly from the sidewall and toward the central axis. An upper portion of each leg connects the leg with the base wall and has a radially outermost edge offset toward the central axis with respect to the sidewall. Preferably, each leg includes a leg sidewall having a generally cylindrical portion, a first, open end integrally formed with the base wall and a second end. An end wall encloses the second end of the leg sidewall and has a generally flat section providing a foot surface configured to support the container on a surface. Preferably, the leg sidewall has a closed perimeter extending proximal the open end. A continuous blend zone portion extends about the closed perimeter of the leg sidewall and integrally connects the leg with the base wall, the blend zone portion being generally curved and having a center of curvature located externally of the container. Further, each leg is preferably defined in a cross section generally perpendicular to the central axis that has a shape that is generally either circular or ovular.

8 Claims, 4 Drawing Sheets

CONTAINER WITH BASE HAVING CYLINDRICAL LEGS WITH CIRCULAR FEET

BACKGROUND OF THE INVENTION

The present invention relates to beverage containers, and more particularly, to self-standing plastic carbonated beverage containers with bases having legs providing foot surfaces to support the container.

Plastic containers, particularly blow-molded plastic containers for storing pressurized liquids, have assumed increasing importance in the beverage container market. Plastic containers have the advantage of being light weight, relatively inexpensive to produce, and are more resistant to breakage and other types of impact damage than are containers made of metal, ceramics or glass.

Typically, plastic containers are manufactured using a process primarily comprised of two molding operations. In the first step, a parison or preform is formed in an injection mold using standard molding techniques. During the injection molding process, liquefied plastic material is inserted into the mold and contacts the inner mold surfaces that are cooled by internally circulated water, such that the liquefied material solidifies into the desired shape of the preform. The resulting preform is generally tubular-shaped with a circular cross-section and has an open end and an enclosed end.

As a result of cooling the liquefied material to form the solid preform, the preform is extracted from the injection mold at a relatively cool temperature that is unsuitable for the second molding operation. Therefore, the preform must be heated to at least a minimum temperature such that preform becomes sufficiently ductile or stretchable to be blow-molded, as discussed below. The minimum required temperature is dependent upon the intrinsic viscosity of the preform material, which is a measure of the material's resistance to being formed or stretched. Thus, the greater the intrinsic viscosity of the resin, the higher the required minimum temperature to bring the preform to a state suitable for blow-molding. Further, the thicker that the preform is made, the higher the molding temperature should be as it is more difficult to stretch thicker material.

Ordinarily, the preform is transported through a heated area, such as a production oven, so that thermal energy is transferred to the preform to raise it to the desired minimum temperature. The preform is located within the oven for a period of time sufficient to raise the preform to the desired molding temperature. Therefore, the preform will be heated for a longer period of time if the intrinsic viscosity or thickness of the preform dictates that a higher forming temperature is required. Further, a thick preform must generally be heated for a relatively longer period of time, even if to achieve the same temperature as a thinner preform, as the greater amount of material requires more thermal energy to raise the temperature of the preform.

After heating to an appropriate temperature, the preform is placed within a blow mold. The blow mold has an internal cavity defined by wall surfaces that have been machined to the desired outer dimensions and shape of the molded container. Compressed air or another suitable pressurized gas is directed or "blown" into the hollow center of the preform such that the preform material stretches both radially outwardly and axially downwardly into contact with the mold surfaces. As the mold walls are cooled by internally circulating water, the heated material of the preform solidifies into a final shape provided by the mold walls substantially immediately upon contact with the walls.

Often, plastic containers are formed on a variation of the molding process called "stretch-blow molding". Stretch-blow molding is essentially the same basic process described above with the additional feature that a stretch rod is inserted through the center of the preform immediately before or after or simultaneous with the injection of the pressurized gas. The movement of the stretch rod facilitates the downward stretching of the preform toward the lower end of the blow mold.

In particular, the molding of the container base introduces several limitations into the manufacturing process. One limitation is that the larger the desired diameter of the finished base, the greater the gas pressure required to force the material to expand outwardly to reach the mold surfaces when the gas flow rate remains constant. However, the higher the pressure used to form the container, the greater the chance the force of the pressurized gas will cause a rupture in the container material, a situation referred to in the container-forming art as "blow-through". Blow-through tends to occur most often in the outer sections of the container base as the material is stretched further than at other sections of the container. Therefore, the higher the molding pressure used to form the container, the greater the required minimum thickness of the preform to prevent "blow-through" from occurring.

Further, as mentioned above, the greater the thickness of the preform used to make a given container, the higher that the molding temperature of the preform should be to enable the preform to stretch sufficiently during blow molding. The ability of the preform to stretch is most critical for forming the outer, lowermost portions of a container base as the preform must stretch the furthest distances both axially and radially to reach the mold surfaces that form these container portions. Another limitation is that, given only a specified amount of time for heating the preform, when the thickness of the preform is increased, the intrinsic viscosity of the preform material may be limited to below a maximum value so that the preform remains sufficiently stretchable to form the container. Thus, certain polymeric resins having a higher intrinsic viscosity may be unusable for making a container with a greater finished thickness or in a more time critical process.

Each of the above-discussed limitations to the container forming process affects what is referred to as the "process window", which is a set of process parameters that must be carefully controlled in order to produce commercially acceptable containers on a reliable basis. The factors included in the process window include the molding temperature of the preform, material viscosity, dwell time in the mold, pressure of the air/gas blown into the preform and, in stretch blow-molding operations, the stretch force of the rod exerted on the preform during the blow-molding process. Controlling the process window is critical for efficient manufacturing of the containers as the containers are produced in a high speed environment such that slight variations, minor modifications or aberrant fluctuations in any one of these parameters may lead to the fabrication of containers that are unacceptable.

When the specific configuration of the container is such that the range of acceptable values for any of the process parameters is decreased (e.g., by increasing the required molding temperature of the preform), the more critical it becomes to control these parameters, leading to a situation called a "narrow process window". With a narrow process window, there is little allowance for even slight changes to any of the process parameters. Therefore, the container-forming industry is constantly seeking new ways to "widen"

the process window so as to increase the rate of production of acceptable containers.

Numerous types of known plastic containers, particularly for use in containing liquids at elevated pressures, are produced using the blow-molding process generally described above. These containers are generally of either two-piece construction, in which a separate base is attached to the remainder of the container, or a one-piece construction having an integral base structure. Referring to FIG. 1, a typical two-piece container 1 has a main container body 2 for holding the intended contents of the container 1 and a separate base member or cup 3 which is attached to the lower end of the main body 2 to enable the container body 2 to be supported in an upright position on a surface S. Each component 2, 3 of the container 1 is molded in a separate process and then the two components 2,3 are assembled together in a third, subsequent process, generally by gluing the base cup 3 to the container body 2. Typically, the container body 2 is transparent and made of polyethylene terephthalate ("PET") and the base cup 3 is formed of opaque high density polyethylene (HDPE).

Generally, the one-piece plastic container with an integral base is preferable as it requires less material and less processing to manufacture. Examples of one-piece plastic containers are found in U.S. Pat. No. 5,320,230 to Hsiung entitled "Base Configuration for Biaxial Stretched Blow-Molded PET Containers"; U.S. Pat. No. 5,353,954 to Steward et al. entitled "Large Radius Footed Container"; U.S. Pat. No. 5,484,072 to Beck et al. entitled "Self-standing Polyester Containers for Carbonated Beverages"; U.S. Pat. No. 5,549,210 to Cheng entitled "Wide Stance Footed Bottle with Radially Non-Uniform Circumference Footprint"; and U.S. Pat. No. 5,603,423 to Lynn et al. entitled "Plastic Container for Carbonated Beverages".

Referring now to FIGS. 2–4, a common type of one-piece plastic container 10 has a base 14 generally adapted from the base cup 3 of the two-piece container shown in FIG. 1. As best shown in FIG. 4, the base 14 has a cross-section formed generally as a barrel with an annular ring so as to be self-standing. One problem with the base structure is that the concave central portion 19 of the base 14 has the tendency to deflect or "pop" outwardly by the pressure of carbonation gas when the container 10 is filled with a substance such as a carbonated beverage. To prevent the outward deflection of the central portion 19, reinforcing ribs 24 were added to the base structure such that the base 14 is divided into several individual legs 16. The resulting base structure is commonly referred to as "petaloid" (i.e., resembling the petals of a flower).

More specifically, such petaloid bases 14 are typically formed of three or more legs 16 extending downwardly from the sidewall 12 that forms the main portion of the container 10. Each leg 16 is multi-sided or multi-faced and is formed of an outer side wall 17 extending generally continuously from the container side wall 12, an inner side wall 18 connected with a central portion 19 of the base 14 and two radially-extending and converging side walls 20A, 20B. An end wall 22 encloses the lower ends of the four side walls 17, 18, 20A and 20B and provides a foot surface 21 so that the container 10 may be placed in a "standing" position upon a surface S. Further, as discussed above, each adjacent pair of legs 16 is separated by a rib 24, such that the base 14 has a number of ribs equal to the number of legs 16. Each rib 24 extends between the side wall 12 and the central base portion 19 and has a generally arcuate shape.

By having legs 16 formed of a four distinct side walls and a separate enclosing end wall, regions of high stress concentration are formed. In particular, high stress concentration occurs in the base sections located at each inner corner of the legs 16, designated as region "I" in FIG. 3. The region I encompasses the intersection of four leg surfaces: the inner wall 18, one of the side walls 20A, 20B, the central base portion 19 and the proximal rib 24. Although this region, as with the central region 19, tends to have less biaxial orientation than other portions of the container 10 since less stretching of the preform occurs in this region during the molding process, the relatively high rate of stress failure of containers 10 in this area is primarily due to the geometric stress concentration arising from the intersections of the several surfaces. When the container 10 is filled with a pressurized substance, the walls of the legs 16, the ribs 24, and the central portion 19, deflect outwardly further at their respective central regions than at the relatively stiff regions of intersection with the various other wall portions. The deflection of these various wall portions cause sheer stress to be concentrated at the regions of intersection between the walls (in a manner analogous to a bending cantilever), which effect is multiplied by the convergence of several lines of intersection.

The base region I, as described above, is the area of the container 10 that is most likely to experience a failure mechanism referred to as "environmental stress cracking". Environmental stress cracking is the most common and most serious mode of failure for containers constructed of PET, such as the containers 10. Due to the stress concentration in region I arising from the structure of the legs 16 (as described above), the resulting magnitude of the stress experienced in this region of each leg 16 causes, over a period of several days or weeks, a gradual breakdown of the molecular structure of the PET material in the region I, initially causing one or more microscopic openings to form in the region I. Once an opening is formed, the stress concentration is further magnified at the opening such that the opening becomes greatly enlarged, leading to a catastrophic failure of the container 10.

A failure of a container 10 due to environmental stress cracking ordinarily occurs after a period of at least several days after the container 10 is filled with a pressurized substance, such as a carbonated soft drink. Therefore, the failure of the container 10 not only results in a loss of the container 10, but also a loss of the pressurized contents. Particularly when the contents of the container 10 is a quantity of a carbonated soft drink and the failed container 10 is stored with numerous other containers 10, the resulting spillage of the contents leads to a relatively labor intensive cleaning process to remove the spilled contents from the surrounding area.

Ordinarily, PET material is characteristically tough and durable such that failure of the containers 10 due to environmental stress cracking would generally not occur without the stress concentration introduced by the multi-sided structure of the legs 16. Environmental stress cracking is most likely to occur when the containers 10 are stored under conditions that are not optimal. Ideally, the containers 10 should be stored with the lowest feasible carbonation pressure and at the lowest temperature possible to minimize carbonation pressure. Clearly, by having a lower pressure, the stress in the walls of the container 10, such as in region I, will be minimized. Further, the containers 10 should be free of the lubricants that are used to facilitate handling of the containers 10 during the container-filling process. These lubricants, which are typically liberally applied to the containers 10 so as to have maximum effectiveness during the handling operations, contain chemicals which can cause PET material to break-down.

In reality, however, the ideal conditions are not generally attainable for the following reasons. Consumers prefer higher levels of carbonation in the beverages that they drink. Also, it is generally impossible or at least economically unfeasible to control the temperature of storage areas, such as warehouses or trailer trucks. Further, processes for removing the lubricants from the containers 10 are generally too costly to be implemented, such that the containers 10 are typically stored with a certain amount of the lubricant coating the base 14. Therefore, due to the presence of these factors, the resulting environmental stress cracking has led to an unacceptable number of failures of the prior art containers 10.

One container having a leg configuration that reduces the stress concentration effect of multi-sided legs is disclosed in U.S. Pat. No. 4,318,489 of Snyder et al. ("Snyder"). As shown in FIGS. 5–7, the Snyder container 110 has a base 114 formed of a plurality of bulbous or "spherical" legs 116 extending downwardly from a generally hemispherical base portion 114. Each leg 116 has a radially outermost wall portion 116*a* that is generally "vertically aligned" with the side wall 112 of the container 110 and the remaining upper end of each leg 116 intersects with the hemispherical portion 115, as best shown in FIGS. 6 and 7. Although the Snyder container 110 eliminates the multi-sided leg structure to thereby reduce stress concentration in the base region I (as described above), the configuration of base 114 introduces other deficiencies, as described below, that are not present in the typical container 10.

By having legs 116 that are bulbous or spherically-shaped, each leg 116 has only a relatively small foot surface 121. Therefore, when the Snyder container 110 is placed on a surface S, the container 110 is essentially supported on a plurality of points (i.e., the apexes of the surfaces 121) such that friction between the container 110 and the surface S is substantially less than with the common petaloid container 10. The minimal friction increases the likelihood that the container 110 will either tip over or slide rather than remain stationary relative to the surface S when subjected to an external force, which is particularly problematic for the handling of numerous empty containers 110, such as when the container 110 is located upon a tabletop conveyor (not shown) during a "bottling" or other container-filling operation.

Furthermore, as each foot surface 121 is located at approximately the center of the respective leg 116, the legs 116 should be located as far from the central axis 111 of the container 110 as possible so that the container 110 has a sufficient standing ring R. In general, the greater the standing ring of any container, the greater the container's stability and the less likely the container is to tip over during handling. This is due to the individual foot surfaces (e.g., 121) of the container being located further from the container's center of mass (which is located on the central axis 111), and thus each having a longer lever arm with which to resist a "tipping" moment arising from a force applied to the container. Therefore, the structure of the legs 116 having foot surfaces 121 only at about the middle thereof dictates that the legs 116 should located with the outermost edges 116*a* of each leg 116 vertically aligned with the side wall 112 of the container 110 for purposes of stability.

Another serious limitation of the Snyder container 110 results from the configuration of the legs 116 having an outer edge 116*a* "vertically aligned" with the side wall 112. By being "vertically aligned", the outer edge 116*a* of each leg 116 is thus located at the maximum distance from the center line 111 of the container 110. Therefore, when forming the legs 116, the preform material has to stretch to both the maximum radial and axial distances of the container 110, thereby causing the material in this region to thin to the extent that blow-through is likely to occur. Increasing the thickness of the preform to alleviate the excessive thinning necessitates increasing the pressure of the injected air so that the preform material stretches a sufficient distance to form the vertically-aligned outer edge 116 of each leg 116. However, the increased air pressure itself will likely cause blow through to occur. Therefore, the Snyder container 110 is only potentially produceable in a smaller size, such as of the now common "twenty-ounce" variety.

Furthermore, a problem that is common to both types of prior art containers 10, 110 described above is that, during formation of the container base 14, 114, the material forming the lower, outer edges of the legs 16, 116 (indicated in the drawings as region "O") undergoes greater stretching than at any other section of the container 10. This is due to the preform material in these regions having to be stretched both the greatest axial distance (as with the bottom surface of the base 14, 114 generally) and to stretch almost the same radial distance as the sidewall 12, 112. Due to the substantial amount of stretching of the material, if the preform is not sufficiently thick, the region O of each leg 16, 116 tends to become over-stretched and form an opaque section of material referred to as "pearled". Pearled areas are extremely thin and become easily wrinkled or dented, either outwardly from the internal pressure of the pressurized substance or inwardly from impact to the container (e.g., from being dropped). Further, pearled areas diminish the aesthetic appeal of the container 10, 110 to a consumer as there is the general expectation, particularly with carbonated beverage applications, that the walls should be generally transparent as with the glass containers that PET containers have replaced.

To eliminate the occurrence of pearling in the outer areas of the legs 16, 116, the thickness of the preform may be increased, with a corresponding increase in material costs. Another way to minimize the occurrence of pearling is to heat the preform for a longer period of time to increase the molding temperature so that the preform material is more ductile and thus less likely to over-stretch. The increase in heating time results in a reduced process window such that the rate of production of the containers 10, 110 is decreased.

From the foregoing, it will be appreciated that it would be desirable to have a container with an improved base that minimizes the amount of material necessary to manufacture each container. Further, it would be advantageous to provide a container having a design that is resistant to environmental stress cracking. It would also be desirable to provide a container having a sufficiently large foot surface area and/or standing ring so that the container has maximum stability to prevent toppling of the container, particularly during the manufacturing thereof. Furthermore, it would be desirable to provide a container with an improved base configuration such that the process window for manufacturing the container is maximized.

SUMMARY OF THE INVENTION

In one aspect, the present invention is a blow-molded container having a central axis and comprising a sidewall generally centered about the central axis and having an end. A base wall encloses the end of the sidewall. At least one leg extends from the base wall and has a radially outermost portion offset inwardly from the sidewall and toward the central axis.

In another aspect, the present invention is a blow-molded container having a central axis and comprising a sidewall generally centered about the central axis and having an end. A base wall encloses the end of the sidewall. At least one generally cylindrical leg extends from the base wall and has an upper portion connecting the leg with the base wall. The upper portion of the leg has a radially outermost edge offset toward the central axis with respect to the sidewall.

In yet another aspect, the present invention is a container comprising a sidewall having a central axis and at least one end, the sidewall being generally centered about the central axis. A base includes a hemispherical portion integrally formed with and enclosing the end of the sidewall. A plurality of legs extend from and are spaced circumferentially about the hemispherical portion. Each leg has a portion disposed more distal from the central axis than the remainder of the leg and disposed more proximal to the central axis than all portions of the sidewall.

BRIEF DESCRIPTION OF THE SEVERAL VIEWS OF THE DRAWINGS

The foregoing summary, as well as the detailed description of the preferred embodiments of the invention, will be better understood when read in conjunction with the appended drawings. For the purpose of illustrating the invention, there is shown in the drawings, which are diagrammatic, embodiments which are presently preferred. It should be understood, however, that the invention is not limited to the precise arrangements and instrumentalities shown. In the drawings.

DETAILED DESCRIPTION OF THE INVENTION

Figure 8:
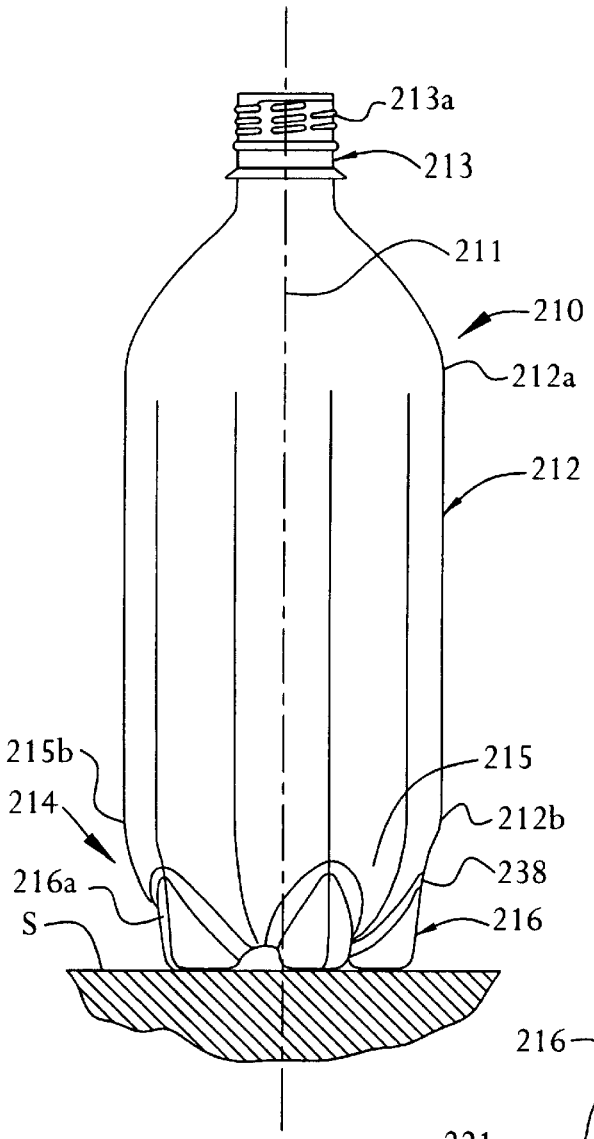
FIG. 8 is a side elevational view of an improved container in accordance with the present invention.
Figure 1:
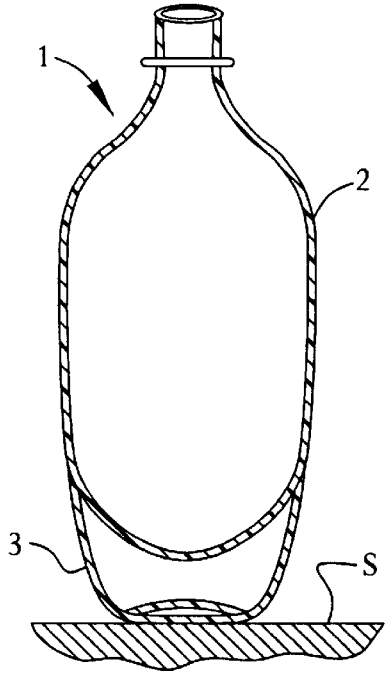
FIG. 1 PRIOR ART
FIG. 1 is a side elevational view in cross-section of a two-piece prior art container.

Certain terminology is used and the following description for convenience only and is not limiting. The words "right", "left", "lower", "upper", "upward", "down" and "downward" designate directions in the drawings to which reference is made. The words "front", "frontward", "rear" and "rearward" refer to directions toward and away from, respectively, either a designated front section of an improved container or a specific portion of the container, the particular meaning intended being readily apparent from the context of the description. The words "inner", "inward", "outer" and "outward" refer to directions toward and away from, respectively, the geometric center of either the container or a portion thereof as will be apparent from the context of the description. The terminology includes the words above specifically mentioned, derivatives thereof, and words of similar import.

Furthermore, the term "radially outermost" as used herein refers to the section of a component of the container, and specifically the section of each leg, that is located the greatest perpendicular distance from the central axis of the container.

Referring now to the drawings in detail, wherein like numerals are used to indicate like elements throughout, there is shown in FIGS. 8–12, a first preferred embodiment of an improved container 210 with a central axis 211. The container 210 generally comprises an upper neck portion 213, a generally cylindrical side wall 212 having a first, upper end 212*a* extending from the neck 213 and a second, lower end 212*b*, and a base 214 enclosing the second end 212*b* of the side wall 212. The base 214 has a generally hemispherical portion 215 having a first, upper end 215*b*, formed integrally with the second end 212*b* of the side wall 212, and at least one leg 216, and preferably a plurality of legs 216 extending from and circumferentially spaced about the hemispherical portion 215.

Each leg 216 has a radially outermost portion 216*a* that is integrally joined to the hemispherical portion 215 by an exterior concave region 238. By being joined to the hemispherical portion 215 by the exterior concave region 238, the outermost portion 216*a* of each leg 216 is offset inwardly with respect to the sidewall 212 such that the radially outermost portion 216*a* is disposed more proximal to the central axis 211 of the container 210 than is any portion of the side wall 212, resulting in important benefits as described below. Each of the above-recited elements of the improved container 210 will be described in further detail below.

Preferably, the improved container 210 is constructed of polyethylene terephthalate ("PET") as this material due to its inherent flow characteristics as described in the Background of the Invention section of this application. However, the improved container 210 may be constructed of a variety of other plastic resins having satisfactory characteristics, such as for example, ductility or "stretchability" and intrinsic viscosity. Such other appropriate materials include, for example, other saturated polyesters, polyvinyl chloride, nylon and polypropylene. The present invention is intended to embrace an improved container 210 as described herein formed of any appropriate polymeric material.

As shown in FIG. 8, the container 210 is preferably a blow-molded beverage container of the type generally used to contain pressurized substances, such as, for example, carbonated beverages. Most preferably, the container 210 is constructed as the type of container commonly referred to as a "2-liter bottle" well known in the carbonated beverage industry and to ordinary consumers alike. However, it is within the scope of the present invention to construct the improved container 210 as any other type of carbonated beverage container, such as, for example, a "1-liter" bottle used for carbonated beverages. Further, the container may be configured as any other type of container for any desired pressurized or non-pressurized liquid, such as, for example, a modification of the known, commercially available half-gallon plastic milk container.

Still referring to FIG. 8, the improved container 210, as noted above, is preferably constructed having the elements common to a plastic beverage container, particularly of the 2-liter variety, except for the structure of the base 214. More specifically, the neck 213 is generally cylindrical with a circular cross-section and includes external molded threads 213*a* configured to enable attachment of an internally threaded bottle cap (not shown). Further, the side wall 212 is generally cylindrical with a circular cross-section and has a diameter substantially greater than the diameter of the neck 213. Further, the container 210 preferably includes a generally frusto-conical transition section 225 extending between and integrally joining the neck 213 to the cylindrical side wall 212. As described above, the base portion 214 of the container encloses the lower end 212*b* of the cylindrical side wall 212.

Although the elements of the improved container 210 common to prior art containers are constructed as described above and below and depicted in drawing figures, it is within the scope of the present invention to construct the improved container 210 in any other appropriate or desired manner. For example, the side wall 212 may alternatively include ornamental or even functional ridges (not shown) disposed at the first or second ends 212*a,* 212*b,* respectively, of the sidewall 212. Further, the side wall 212 may alternatively be shaped, although not preferred, with an ovular cross-section, a rectangular or square cross-section or in any other appropriate manner depending on the preferred manufacturing method for, and/or the common elements of desired application of the improved container 210. Further, the neck region 213 may alternatively be formed having another appropriate cross-sectional shape and/or formed without threads 213*a*. The present invention is intended to embrace these and any other alternative configurations and or constructions of the common elements of the improved container 210 as long as the container 210 includes a base 214 having cylindrical legs 216 as described above and below.

Referring now to FIGS. 8–12, the base 214 preferably includes a plurality of cylindrical legs 216, most preferably five cylindrical legs 216, extending from and integrally joined with the hemispherical portion 215. The five legs 216 are spaced generally evenly about the circumference of the base 214 so as to be located generally equidistant from the central axis 211 of the container 210. However, the base 214 may alternatively be formed with any number of legs 216 spaced evenly or unevenly thereabout.

Figure 11:
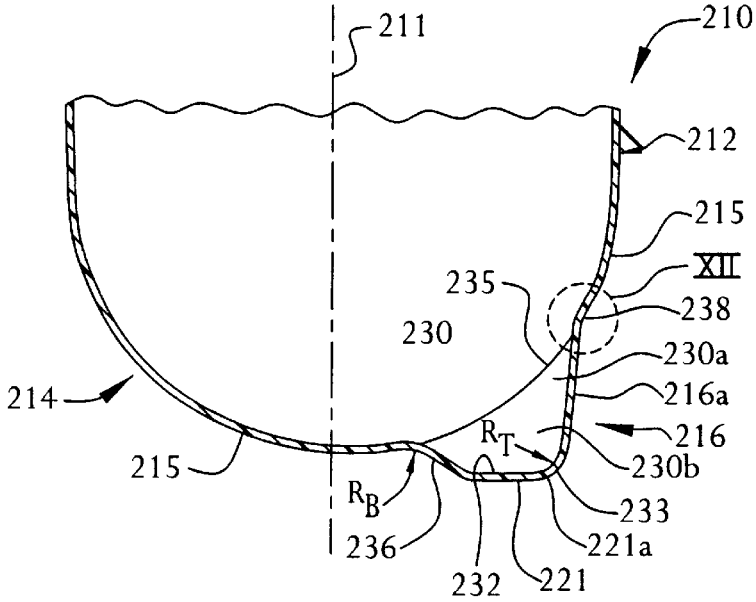
FIG. 11 is a partially broken-away, side cross-sectional view of the improved container taken through line XI—XI of FIG. 10.

As best shown in FIG. 11, each leg 216 has a first, open end 235 integrally formed with the hemispherical portion 215 of the base 216 and a side wall 230 extending from the first end 235 and having a truncated cylindrical section 230*b* and a generally cylindrical portion 230*a*. Each leg 216 further includes a generally circular end or base wall 232 enclosing the side wall 230 and having a generally flat section providing an circular foot surface 221. As described below, the foot surface 221 is configured to support the container 210 in an upright standing position upon an external surface S, such as, for example, a household table top or a working surface of a bottling or other container-filling machine (none shown).

Figure 9:
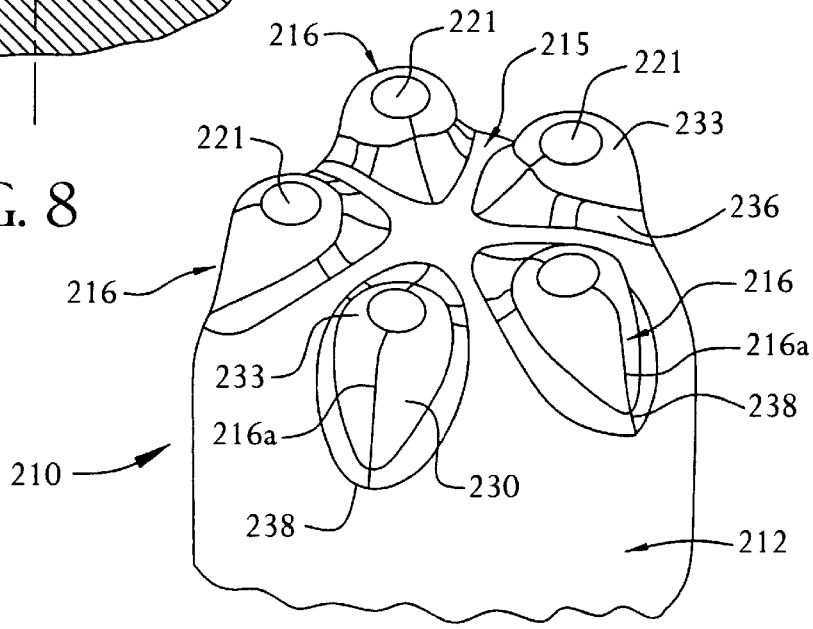
FIG. 9 is a partially broken-away, bottom perspective view of the improved container.
Figure 10:
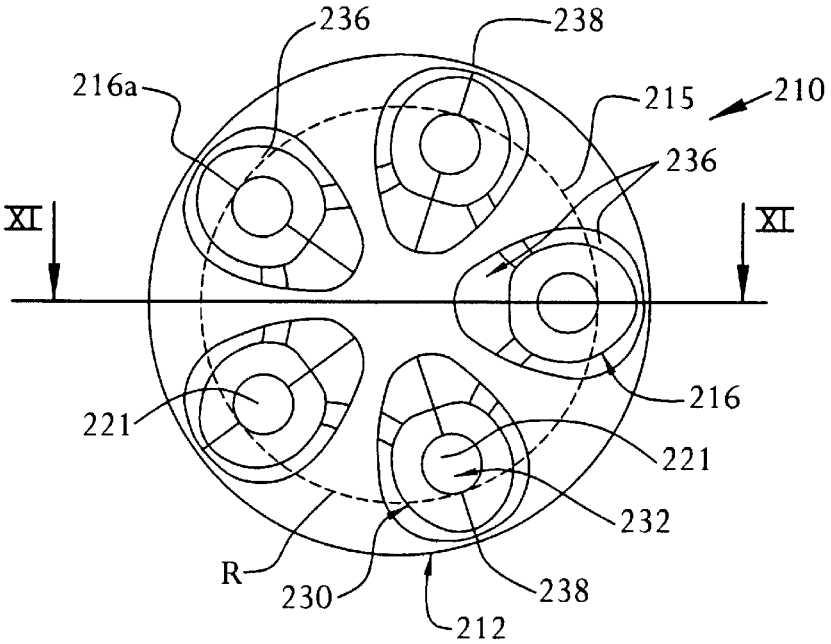
FIG. 10 is a bottom plan view of the improved container.

Referring now to FIGS. 9–11, the end wall 232 of each leg 216 is generally flat and circular and is integrally joined with the side wall 230 by a smoothly curved transition zone 233. The transition zone 233 has a substantial radius $R_T$ that is preferably generally constant about the perimeter of the end wall 232 such that the transition zone 233 has a generally uniform annular shape. By having such a transition zone 233 between the side wall 230 and the end wall 232 this section of each leg 216 has no sharp corners or sharp radiuses such that stress concentration is essentially eliminated therein. Further, the elimination of the sharp corners in this area of each leg 216 also eliminates the problem of creasing or wrinkling of the corners, which commonly occurs with containers 10 having multi-sided legs 16 upon carbonation.

Further, as each foot surface 221 extends across a substantial portion of the horizontal cross-sectional area of each leg 216, the radially outermost edge 221*a* of each foot surface 221 extends proximal to the radially outermost portion 216*a* of each leg 216. Therefore, the container 210 has a substantially large standing ring R with a diameter $D_R$ that approaches or even exceeds the diameter of the standing rings of prior art containers, such as containers 10 and 110 shown in FIGS. 2–7, even though the legs 216 themselves are disposed further radially inwardly, and formed with significantly less material, than the legs (e.g. 16 and 116) of prior art containers, as discussed in detail below.

Referring again to FIGS. 8–11, each leg 216 is preferably integrally connected with the hemispherical base wall 215 by a continuous, inwardly-curved blend zone 236 extending completely about the perimeter of the first, open end 235 of each leg 216. The term "continuous" as used to describe the blend zone 236 means extending in a closed, uninterrupted curvilinear path. Preferably, the continuous blend zone 236 is formed so as to have at least a minimum outer radius $R_B$ of a substantial magnitude at all sections thereof such that the blend zone 236 has no sharp corners or curves. By having both the blend zone 236 at the juncture between the open end 235 of the leg 216 and the hemispherical base wall 215 and the transition zone 233 (as described above), the container 210 has essentially no stress concentration due to the geometric structure of the legs 216 and/or the base 214. By eliminating stress concentration in the legs 216 and the base 214, the container 210 also has the benefit of significantly higher resistance to environmental stress cracking compared to prior art containers, such as containers 10 and 110.

Alternatively, although not preferred, the blend zone 236 may be constructed so as to have a generally sharp radius $R_B$, having two or more alternating curved sections so as to form a "rippled" area, and/or having a generally straight-walled portion connecting the leg 216 to the hemispherical base portion 215 in the manner analogous to a chamfered corner (none shown). The present invention is intended to embrace these and any other alternative configurations for the continuous blend zone 236 as long as the radially outermost portion 216*a* of each leg 216 is offset inwardly from the side wall 212 of the container 210, as described above and in further detail below.

Figure 12:
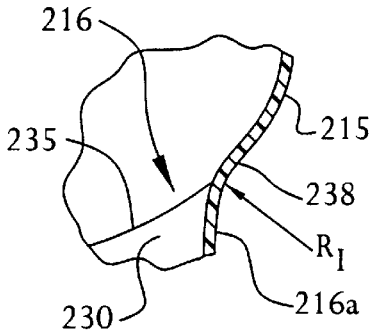
FIG. 12 is a greatly enlarged view of section XII indicated in FIG. 11.

Referring now to FIGS. 11 and 12, as mentioned above, the radially outermost portion or outer edge 216*a* of each leg 216 (i.e., located the greatest perpendicular distance from the central axis 211 as defined above) is integrally connected with the hemispherical portion 215 of the base 214 by an outer or exterior concave intersection zone 238. By being connected with the hemispherical base wall 215 through the concave intersection zone 238, the outer edge 216*a* of each leg 216, and thus the remainder of the leg 216, is inwardly offset from or with respect to the side wall 212 and toward the central axis 211 of the container 210. Therefore, the entire leg 216 is disposed more proximal to the central axis 211 of the container than all portions of the side wall 212.

Preferably, the concave intersection zone 238 forms a continuous portion of the blend zone 236. Further, the concave intersection zone 238 preferably has a "vertical profile" (defined herein as the cross-section formed by a generally vertical section line) constructed as a continuous curve having a radius or radii $R_I$ with a center(s) (not shown) located externally of the container 210 and below the upper end 235 of the leg 216, as best shown in FIG. 12. With such a vertical profile, the concave intersection zone 238 provides a relatively gradual and smooth transition between the hemispherical portion 215 of the base 214 and the open end 235 of the leg 216 so as to eliminate any potential for stress concentration in this area of the container 210. Alternatively, as with the continuous blend zone 236 in general, the concave intersection zone 238 may be formed by two or more alternating curves so as to create "ripples", by a generally straight-walled portion, or in any other manner (none shown) as long as the radially outermost edge 216*a* of the leg 216 is inwardly offset with respect to the cylindrical side wall 212 for the reasons discussed below.

By having the above-described concave intersection zone 238 connecting the radially outermost portion 216*a* of each leg 216 to the hemispherical base wall 215, as stated above, each leg 216 is thereby completely or entirely offset inwardly towards the central axis 211 of the container 210 with respect to the sidewall 212. Without an intersection zone 238 as described, the radially outermost portion 216*a* of each leg 216 would be connected with the base 214 in one of two manners. Either the outermost portion 216*a* would be vertically-aligned with the side wall 212 (FIGS. 4 and 7) with the prior art containers 10, 110, or would be joined by a concave intersection zone having a radius of curvature centered above the top of the leg, such that the radially outermost portion would be disposed further from the central axis 211 than the side wall 212 (i.e., with a base 214 wider than the side wall 212).

There are several advantages inuring to the improved container 210 by having a base 214 configured so that each leg 216 is entirely inwardly offset toward the central axis 211 with respect to the side wall 212. One advantage is that during the blow-molding of the container 210, the material in the preform (not shown) is not required to be stretched as far from the central axis 211 during formation of each leg 216 as compared with other prior art containers. As a consequence, the material used to form the legs 216 is much less likely to become over-stretched during the blow molding process, and thus the occurrence of pearling and blow-through is significantly reduced. With pearling and blow-through being less likely to occur, the preform used to form the improved container 210 may be made of substantially less thickness than the minimum thickness required for the preforms used to make prior art containers (e.g., 10 and 110).

Therefore, the improved container 210 may be made with significantly less material than is needed to produce acceptable prior art containers on a consistent basis. Further, with less stretching of the preform being required to form the legs 216 (and the base 214 in general), the preform used to form the container 210 does not need to be heated to as high a temperature before blow-molding such that the rate of production and the process window are both increased. For the same reason, resins with a higher intrinsic viscosity (and thus less ductile) may be used to form the improved container 210 than would be feasible with prior art containers, further increasing the process window.

Another advantage to having legs 216 located inwardly from the side wall 212 of the container 210 is that the overall surface area and volume of each leg 216, and thus the amount of material necessary to form the leg 216, is significantly reduced compared to the legs (e.g., 16 and 116) of prior art containers. This reduction in leg surface area/volume by the inward placement of the legs 216 is due to several factors as described below.

Figure 2:
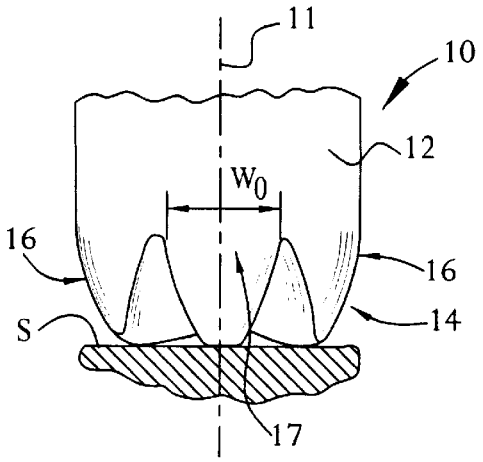
FIG. 2 PRIOR ART
FIG. 2 is a partially broken-away, elevational view of a prior art one-piece plastic container showing the integral base portion thereof.
Figure 5:
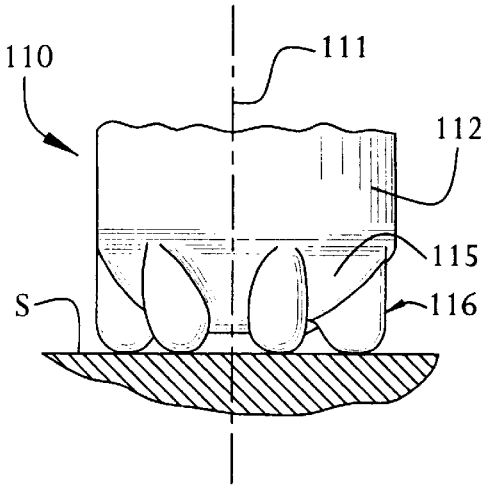
FIG. 5 PRIOR ART
FIG. 5 is a partially broken-away elevational view of a second type of prior art container having an integral base.

First, one reason the legs require less material than the legs of prior art containers 10, 110 derives from the fact that essentially all blow-molded containers, such as for example the prior art containers 10, 110, have a hemispherically-shaped end wall or portion 15, even when the structure of the legs (e.g., 16 and 116) is such that the hemispherical portion 15 is reduced to only the rib portions 24, 124 between the legs 16, 116 and the central base portion 19, 119, as shown in FIGS. 2 and 5. Thus, the further toward the central axis 211 that the leg 216 is located, the less minimum overall height is required for each leg 216 to "bridge" the distance between the hemispherical portion 215 and a surface S. This is due to the fact that, as the radial distance from the central axis 11 of a container 10 increases, the further that the hemispherical portion 15 of the base 14 curves upwardly.

Thus, the legs 16, 116 of the prior art containers 10, 110, being positioned radially outwardly further than the legs 216 of the improved container 210, are required to be made with a greater height and thus require more material than the legs 216 of the improved container 210. Therefore, the preform used to make the improved container 210 may be made thinner, and with less material, than the preforms used to make the prior art containers for this reason also.

Figure 3:
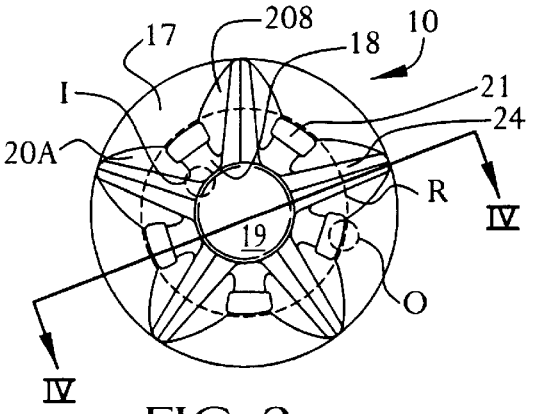
FIG. 3 PRIOR ART
FIG. 3 is a bottom plan view of the first prior art container.
Figure 6:
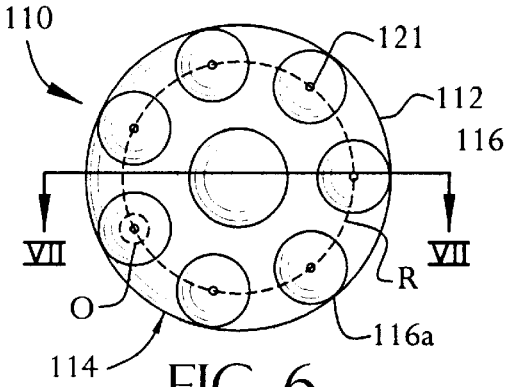
FIG. 6 PRIOR ART
FIG. 6 is a bottom plan view of the second prior art plastic container.
Figure 4:
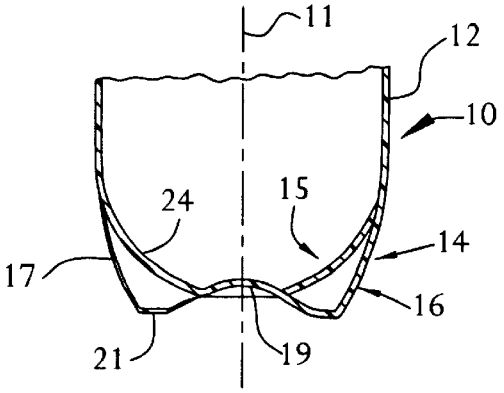
FIG. 4 PRIOR ART
FIG. 4 is a partially broken-away side cross-sectional view of the first prior art container taken through line IV—IV of FIG. 3.
Figure 7:
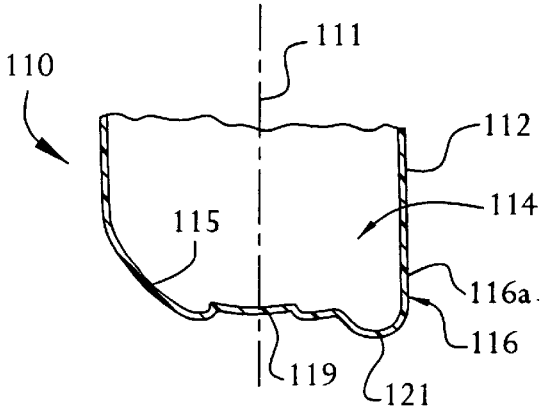
FIG. 7 PRIOR ART
FIG. 7 is a partially broken-away side cross-sectional view of the second prior art container taken through line VII—VII of FIG. 6.

Further, with the prior art containers 10 having multi-sided legs 16 disposed near the outer perimeter of the container 10, the outer wall 17 of the leg 16 extends into or is blended with the sidewall 12. As best shown in FIGS. 2 and 3, the outer wall 17 of each leg 16 has a width $W_O$, particularly at the upper end 17*a*, that extends across a significant portion of the circumference of the sidewall 12. Thus, the multi-sided legs 16 necessarily have a greater surface area so as to blend into or with the sidewall 12. As the legs 216 of the improved container 210 are inwardly offset and do not blend with the sidewall 212, the legs 216 are constructed with a smaller, generally uniform cross-sectional width, and thereby require less material to be formed, than the containers 10 with multi-sided legs 16 for this reason also.

Referring now to FIGS. 9–11, another advantage of the improved container 210 is that the legs 216 each have significantly larger foot surface 221 than that of the prior art container 10 and which far exceeds the foot surface 121 of the Snyder container 110. By having the substantially larger foot surface 221, the frictional force between each leg 216 and a surface S is much greater, enabling the improved container 210 to withstand greater applied forces without falling over or sliding upon a surface S. The increased frictional force, and thus increased stability of the container 210, is particularly critical when the container 210 is located on a tabletop conveyor during a "bottling" or filling operation as sliding or toppling of the containers, such as caused by a collision with another container, may halt or disrupt the bottling operation. When empty, the containers 210, as with the other containers 10, 110, have relatively little weight with which to generate friction with a surface S, and thus the increased friction due to the larger foot surface 221 is a significant advantage to the improved container 210. This advantage is particularly acute when compared to the generally bulbous or spherical legs 116 of the Snyder container 110, which has essentially point contact between each foot 121 and a surface S.

Figure 14:
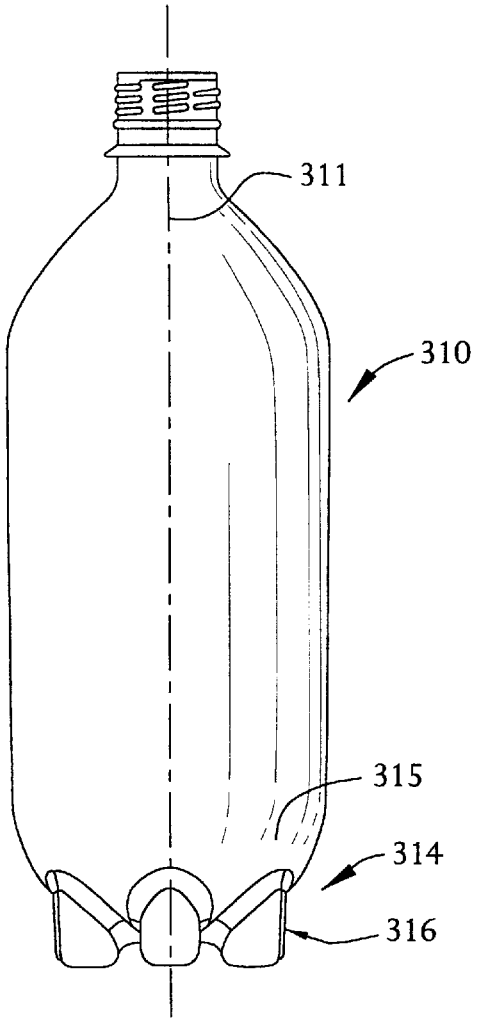
FIG. 14 is a side elevational view of an improved container in accordance with a second embodiment of the present invention.
Figure 13:
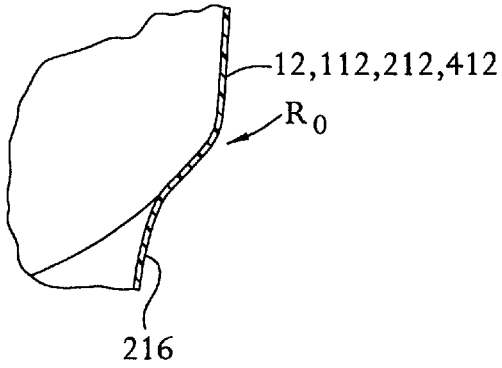
FIG. 13 is a greatly enlarged, diagrammatic cross-sectional view showing the joining of a base leg to a typical container sidewall.
Figure 15:
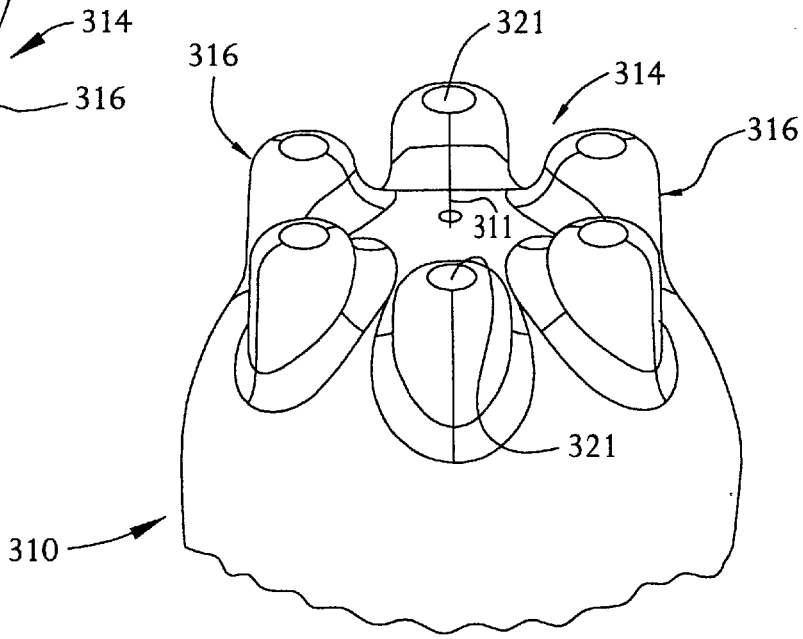
FIG. 15 is a partially broken-away bottom perspective view of the alternative embodiment improved container.

Referring now to FIGS. 14 and 15, there is depicted an alternative construction of the improved container 310. The alternative construction 310 is substantially identical to the first preferred construction of the container 210, except that the base 314 includes six legs 316 circumferentially spaced about the hemispherical portion 315 as opposed to the five legs 216 in the first construction of the container 210. Furthermore, as best shown in FIGS. 14 and 15, each leg 316 is located more proximal to the central axis 311 compared with the radial spacing of the feet 216 from the central axis 211, with the result that even less material is required to form the legs 316 in the alternative embodiment improved container 310. However, by having the legs 316 spaced more proximal to the central axis 311, the standing ring of the container 310 is decreased, thereby increasing the likelihood of the container 310 toppling over by an applied force. Further, there is a disadvantage that, being that the legs 316 are evenly spaced about the circumference, the feet 321 are mirrored about the central axis 311, thereby creating the possibility of the container 310 tilting about two opposing foot sections.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A blow molded container having a longitudinal central axis, the container comprising:

a sidewall substantially centered about the central axis and having an end;

a substantially hemispherical base wall enclosing the end of the sidewall;

a plurality of substantially cylindrical legs spaced circumferentially about and extending from the base wall, the legs having a sidewall and an upper portion connecting the sidewall with the base wall, the upper portion having a radially outermost edge which is offset inwardly from the sidewall toward the central axis, the legs having a substantially flat circular distal end wall providing a foot surface configured to support the container on a surface.

2. The container as recited in claim 1, wherein the legs include an open end which is integrally formed with the base wall.

3. The container as recited in claim 2, wherein the leg sidewall has a closed perimeter extending proximal the open end and the container further comprising a continuous blend zone portion extending about the closed perimeter of the leg sidewall and integrally connecting the legs with the base wall, the blend zone portion being generally curved and having a center of curvature located externally of the base.

4. The container as recited in claim 3, wherein the container is formed of one of polyethylene terephthalate, polyvinyl chloride, nylon, and polyprylene.

5. The container as recited in claim 4 wherein each leg is defined in a cross section generally perpendicular to the central axis and has shape that is generally circular.

6. The container as recited in claim 5, wherein each leg has a portion disposed more distal from the central axis than the remainder of the leg and disposed more proximal to the central axis than container the sidewall.

7. The container as recited in claim 5, further comprising a transitional zone having a substantial radius that is substantially constant about the perimeter of each leg end.

8. The container as recited in claim 5, further comprising an outer concave intersection zone forming a continuous portion of the blend zone.

* * * * *

UNITED STATES PATENT AND TRADEMARK OFFICE

CERTIFICATE OF CORRECTION

PATENT NO. : 6,112,924
DATED : September 5, 2000
INVENTOR(S) : Quichen Peter Zhang It is certified that error appears in the above-identified patent and that said Letters Patent is hereby corrected as shown below:

Title page,
Item [73], Assignee, the correct name of the assignee is: BCB USA Corp.

Signed and Sealed this

Twelfth Day of November, 2002

*Attest:*

*Attesting Officer*

JAMES E. ROGAN
*Director of the United States Patent and Trademark Office*